United States Patent [19]

Akanuma et al.

[11] Patent Number: 4,566,736

[45] Date of Patent: Jan. 28, 1986

[54] APPARATUS FOR MECHANICALLY BREAKING UP ROCK

[75] Inventors: Shigetake Akanuma, Chigasaki; Minoru Nakajima, Hiratsuka; Satoshi Takashima, Kanagawa; Haruo Imamura, Hiratsuka; Yoshitaka Ojiro, Hiratsuka; Hiroshi Kakuta, Hiratsuka; Masato Matsumoto, Minami-ashigara, all of Japan

[73] Assignee: Kabushiki Kaisha Komatsu Seisakusho, Tokyo, Japan

[21] Appl. No.: 608,682

[22] Filed: May 10, 1984

[30] Foreign Application Priority Data

May 10, 1983 [JP] Japan ..... 58-68484[U]

[51] Int. Cl.[4] ..... E21C 37/06; E21C 37/02

[52] U.S. Cl. ..... 299/23; 299/22

[58] Field of Search ..... 299/22, 23; 405/253, 405/254, 255; 411/44, 45, 50, 60, 64, 65, 66; 175/325; 166/215, 216, 217

[56] References Cited

U.S. PATENT DOCUMENTS

| | | | |
|---|---|---|---|
| 3,628,337 | 12/1971 | Stepanich et al. | 405/253 |
| 4,252,375 | 2/1981 | Langfield et al. | 299/23 |
| 4,474,410 | 10/1984 | Ogaki et al. | 299/22 X |

*Primary Examiner*—James A. Leppink
*Assistant Examiner*—Thomas J. Odar
*Attorney, Agent, or Firm*—Armstrong, Nikaido, Marmelstein & Kubovcik

[57] ABSTRACT

Dust-proof membranes are provided across both ends of opposite respective divided surfaces defined by halves of wedge guide members. Each membrane has projections formed as an integral unit along the longitudinal side edges thereof. The projections are thrust into longitudinally extending C-shape cross-section grooves formed along the divided surfaces of the wedge guide members. The groove side surfaces are perpendicular to the bottom surface thereof.

8 Claims, 8 Drawing Figures

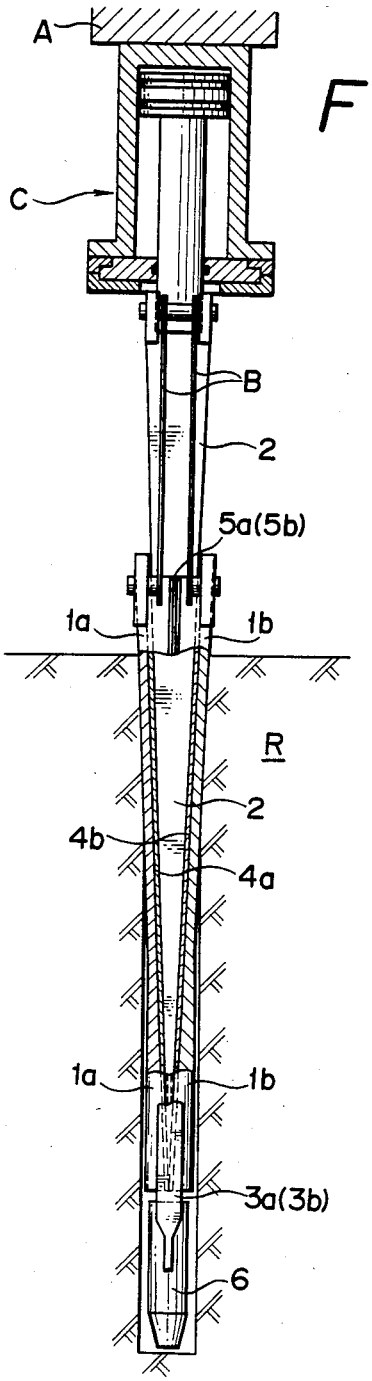
FIG. 7
FIG. 8
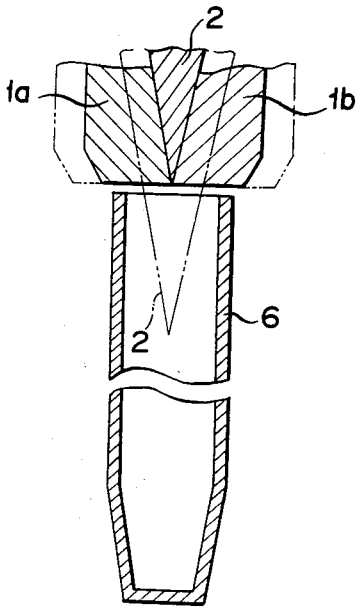

APPARATUS FOR MECHANICALLY BREAKING UP ROCK

BACKGROUND OF THE INVENTION

1. Field of the Invention

This invention relates to an apparatus for mechanically breaking up rock including a single slider wedge which is reciprocable by means of a hydraulically operated actuator etc.

2. Description of the Prior Art

In a convetional rock breaking apparatus wherein wedge guides divided into halves are inserted into a hole which has previously been drilled in a rock to be broken up by means of a hydraulic drill etc., and a single wedge which is reciprocable by means of a hydraulic actuator etc. is thrusted in between the wedge guides to spread the latter thereby breaking up the rock, bellow-shaped dust-proof membranes capable of expansion and contraction are mounted to extend between the opposite surfaces of the afore-mentioned divided wedge guide halves to prevent the earth and sand from entering into the space between the wedge guides.

In that case, the conventional dust-proof membranes are constructed as follows. Stating in brief, the opposed surfaces of the divided wedge guide halves are formed with dovetail grooves in which round bars formed at both side edges of each dust-proof membrane are thrusted in to thereby attach the latter or, as an alternative, a wire is inserted into each of the side edges of the respective membranes, and then terminals formed in both ends of each of the wires are thrusted into the respective dovetail grooves to attach the membranes. However, the former method is disadvantageous in that it is difficult to thrust the round bars into the dovetail grooves, respectively, whilst the latter method is also disadvantageous in that it is difficult to keep the wires taut in the dovetail grooves, and when wires become loose the earth and sand tends to enter into the space between the wedge guide halves through the wire portions.

The conventional rock breaking apparatus is further disadvantageous in that, when the slider wedge is thrusted in between the wedge guides to break up the rock, the leading end of the slider wedge is projected from the tips of the wedge guides and driven into rock debris accumulating the bottom of the hole in the rock thereby causing a damage of the slider wedge, or the crushed rock debris will deposit on the sliding surfaces of the slider wedge thus causing stocking of the latter between the wedge guides.

SUMMARY OF THE INVENTION

The present invention has been made with a view to eliminating the above-mentioned disadvantages, and has for its aim to provide a rock breaking apparatus constructed such that dust-proof membranes may be readily attached between both ends of the opposite divided surfaces of the divided wedge guide halves.

Another aim of the present invention is to provide an apparatus for mechanically breaking up rock, constructed such that the leading end of the slider wedge projecting from the wedge guides when rock is broken up is prevented from being damaged.

A further aim of the present invention is to provide an apparatus for mechanically breaking up rock, constructed such that rock debris are prevented from entering in between the slider wedge and the wedge guides thereby eliminating sticking of the slider wedge between the latter during the rock breaking operation.

To achieve the above-mentioned aims, according to a first characteristic feature of the present invention, there is provided a wedge type rock breaking apparatus, comprising wedge guide members divided into halves and adapted to be inserted into a hole which has previously been drilled in the rock to be broken up; a slider wedge adapted to be thrusted in between said wedge guide members to thereby spread or move the latter away from each other, and a pair of dust-proof membranes adapted to be attached across both ends of the opposite respective divided surfaces of said wedge guide members, characterized by that said dust-proof membranes each have projections formed as an integral unit along both longitudinal side edges thereof, each of said projections being adapted to be thrusted into each of longitudinally extending grooves of a "C"-shaped cross-section formed along the respective divided surfaces of said wedge guide members and on both sides thereof and whose both side surfaces extend at right angles to the bottom surface thereof.

According to a second characteristic feature of the present invention, there is provided a wedge type rock breaking apparatus, characterized by that, in the said first feature, said dust-proof membranes are made of a flexible material.

According to a third characteristic feature of the present invention, there is provided a wedge type rock breaking apparatus, characterized by that, in the said first feature, said projections formed along both side edges of said dust-proof membranes have an approximately diamond-shaped cross-section.

According to a fourth characteristic feature of the present invention, there is provided a wedge type rock breaking apparatus, characterized by that, in the said third feature, each of said projections of an approximately diamond-shaped cross-section has a plurality of thin walled portions formed at a predetermined space interval in the longitudinal direction thereof.

According to a fifth characteristic feature of the present invention, there is provided a wedge type rock breaking apparatus, comprising wedge guide members divided into halves and adapted to be inserted into a hole which has previously been drilled in the rock to be broken up; a slider wedge adapted to be thrusted in between said wedge guide members to thereby spread or move the latter away from each other, and a pair of dust-proof membranes adapted to be attached across both ends of the opposite respective divided surfaces of said wedge guide members, characterized by that said dust-proof membranes each have projections formed as an integral unit along both longitudinal side edges thereof, each of said projections being adapted to be thrusted into each of longitudinally extending grooves of a "C"-shaped cross-section formed along the respective divided surfaces of said wedge guide members and on both sides thereof and whose both side surfaces extend at right angles to the bottom surface thereof, and that said apparatus comprises further a pair of side protectors mounted in opposed relationship with said wedge guide members and whose respective upper ends are connected to members supported by the body of the apparatus, and a cylindrical end protector which includes a bottom portion and which is connected to the respective lower ends of said side protectors and whose open upper end is located opposite to the leading ends of both of said wedge guide members.

According to a sixth characteristic feature of the present invention, there is provided a wedge type rock breaking apparatus, characterized by that, in the said fifth feature, said dust-proof membranes are made of a flexible material.

According to a seventh characteristic feature of the present invention, there is provided a wedge type rock breaking apparatus, characterized by that, in the said fifth feature, said projections formed along both side edges of said dust-proof membranes have an approximately diamond-shaped cross-section.

According to an eighth characteristic feature of the present invention, there is provided a wedge type rock breaking apparatus, characterized by that, in the said seventh feature, said projections of an approximately diamond-shaped cross-section have a plurality of thin walled portions formed at a predetermined space interval in the longitudinal direction thereof.

The above and many other advantages, features and additional objects of the present invention will become apparent to those versed in the art upon making reference to the following detailed description and accompanying drawings in which preferred structural embodiments incorporating the principles of the present invention are shown by way of illustrative example.

BRIEF DESCRIPTION OF THE DRAWINGS

FIG. 7 is a schematic longitudinal sectional view showing the whole wedge type rock breaking apparatus of the present invention inserted into the hole drilled in the rock to be broken up; and FIG. 8 is a fragmentary, enlarged schematic longitudinal section of an end protector portion for use in the wedge type rock breaking apparatus according to the present invention.

DESCRIPTION OF THE PREFERRED EMBODIMENT

Figure 1:
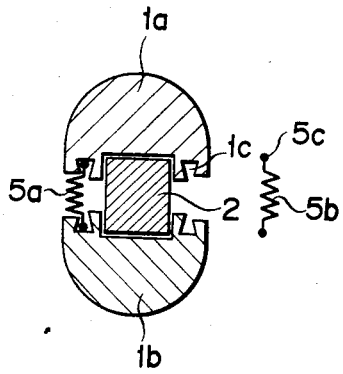
FIG. 1 is a fragmentary schematic cross-sectional view showing portions for attaching dust-proof membranes in a prior art wedge type rock breaking apparatus.
Figure 3:
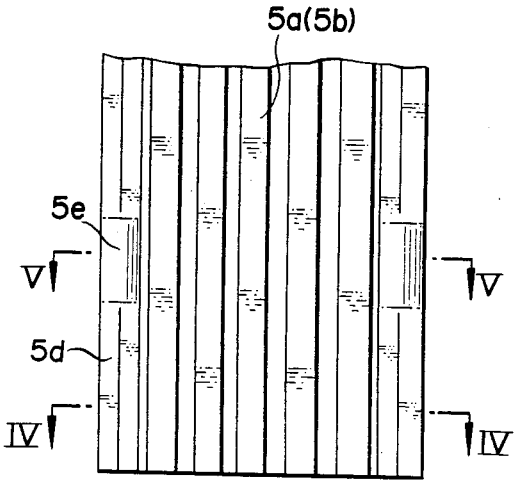
FIG. 3 is a fragmentary schematic plan view of a dust-proof membrane used in the wedge type rock breaking apparatus according to the present invention.

FIG. 1 is a fragmentary, schematic cross-sectional view showing dust-proof membrane attaching portions in a conventional wedge type rock breaking apparatus. Reference numerals 1*a* and 1*b* denote wedge guide members divided in halves and which are located oppositely. A slider wedge 2 is thrusted in between the wedge guide members 1*a* and 1*b*.

Formed along the respective opposite surfaces of the wedge guide members 1*a*, 1*b* and on both sides thereof are pairs of dovetail grooves 1*c*, each of which diverges from the entrance to the base thereof. Bellow-shaped dust-proof membranes 5*a* and 5*b* capable of expansion and contraction are attached between the pairs of opposite dovetail grooves 1*c*.

Figure 2:
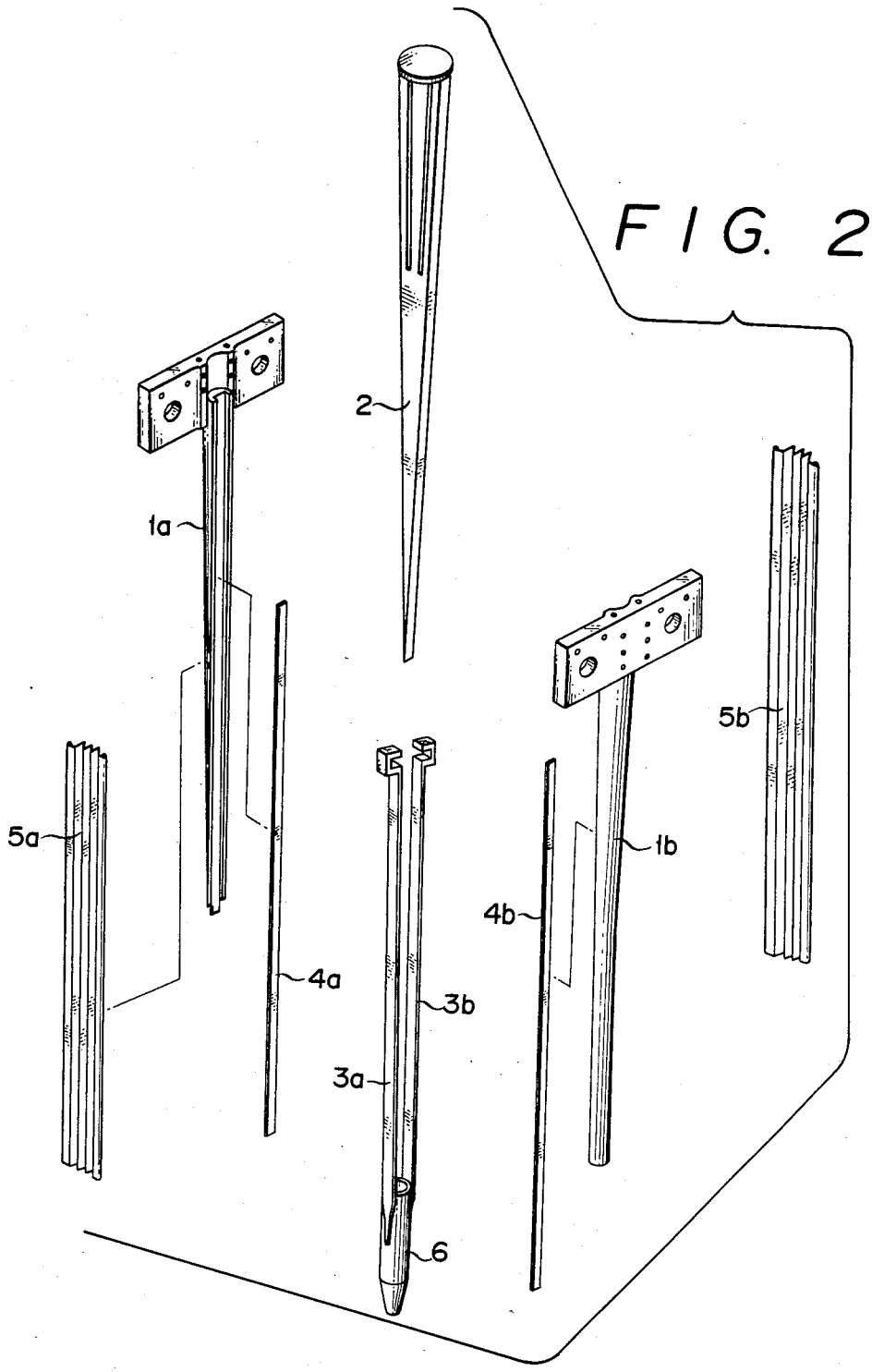
FIG. 2 is an overall schematic exploded perspective view of an embodiment of wedge type rock breaking apparatus according to the present invention.

FIG. 2 is an overall, schematic exploded perspective view of an embodiment of wedge type rock breaking apparatus according to the present invention. As can be seen from FIG. 2, the wedge type rock breaking apparatus according to the present invention comprises wedge guide members 1*a* and 1*b* divided into halves; a slider wedge 2 adapted to be thrusted from above in between said wedge guide members 1*a*, 1*b* by means of a hydraulic actuator not shown to spread or move said wedge guide members away from each other; a pair of side protectors 3*a* and 3*b* mounted in opposed relationship with said two wedge guide members 1*a* and 1*b* and whose upper ends are connected to members (a pair of leaf springs) supported by the body of the apparatus, not shown; a cylindrical end protector 6 provided with a bottom portion and which is connected to the respective lower ends of the side protectors 3*a*, 3*b* and whose open upper end is located opposite to the leading ends of said wedge guide members 1*a* and 1*b*; plates 4*a* and 4*b* having a low frictional coefficient adapted to be attached to the sliding contact surfaces of said wedge guide members 1*a* 1*b*, and bellow-shaped dust-proof membranes 5*a* and 5*b* adapted to to fitted, respectively, in pairs of opposite, longitudinally extending grooves 1*d* (refer to FIG. 6) formed along the respective divided surfaces of said wedge guide members 1*a*, 1*b* and on both sides thereof.

The above-mentioned dust-proof membranes 5*a* and 5*b* will now be described hereinbelow in more detail with reference to FIGS. 3 to 6.

Figure 6:
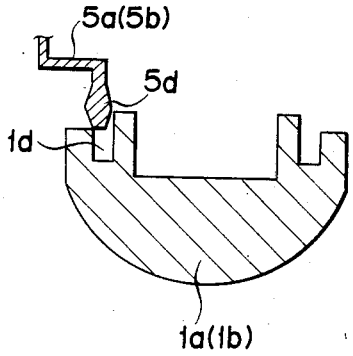
FIG. 6 is an explanatory view showing how to attach the dust-proof membrane used in the wedge type rock breaking apparatus.
Figure 4:
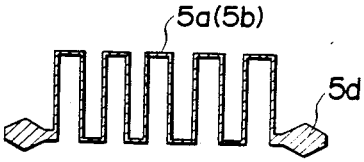
FIG. 4 is a sectional view of the dust-proof membrane taken along line IV—IV in FIG. 3.
Figure 5:
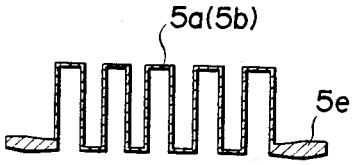
FIG. 5 a sectional view of the dust-proof membrane taken along line V—V in FIG. 3.

The dust-proof membranes 5*a* and 5*b* serve, during rock breaking operation, to prevent rock debris or the earth and sand from entering from the respective divided surfaces of the above-mentioned two wedge guide members 1*a*, 1*b* in the space defined between the latter and the slider wedge 2. The dust-proof memberanes 5*a* and 5*b* are made of a flexible material such as, for example, N.B.R. rubber, polyurethane or the like. As is obvious from FIGS. 4 and 5, the dust-proof membranes 5*a* and 5*b* each have projections 5*d* and 5*e* of an approximately diamond-shaped cross-section, respectively, formed as an integral unit along both side edges thereof. as shown in FIG. 6, out of these projections, the relatively thick walled projections 5*d* thrusted into the longitudinally extending grooves or recesses 1*d* for attaching the dust-proof membranes, formed along the divided surface of each of the wedge guide members 1*a* and 1*b*. Whilst, relatively thin walled projections 5*e* are formed at a predetermined space interval so as to enable the projections formed along both side edges of the dust-proof membranes 5*a* and 5*b* to be readily thrusted into the membrane attaching grooves 1*d*. Further, as can be seen from FIG. 6, the aforementioned membrane attaching grooves 1*d* are different from the conventional dovetail grooves in that they are "C"-shaped grooves wherein both side surfaces thereof rise at right angles with respect to the bottom surface thereof; that is to say; straight grooves. Therefore, the grooves or recesses 1*d* may be easily formed and allow the projection to be thrusted readily therein.

In the next place, the above-mentioned pair of side protectors 3*a*, 3*b* and the end protector 6 adapted to be mounted on the lower ends thereof will be described below with reference to FIGS. 7 and 8.

As shown in FIG. 7, to prevent the dust-proof membranes 5*a* and 5*b* made of a flexible material and adapted to be attached across the wedge guide members 1*a*, 1*b* from being damaged by rock debris striking against them, the upper ends of the side protectors 3*a and 3b* connected to a pair of leaf spring members B, B supported by the body A of the apparatus and are located in the vicinity of the outside of the dust-proof membranes 5*a*, 5*b*. Further, connected to the lower ends of the side protectors 3*a* and 3*b*, respectively, is a cylindrical end protector 6 having a bottom portion and which is located opposite to the lower, leading ends of the above-mentioned wedge guide members 1*a* and 1*b*. The arrangement is made such that, when rock is to be broken up, the end protector 6 is thrusted in downwardly by means of a hydraulic actuator "C" fixedly mounted on the body A of the apparatus so as to protect the lower, leading end of the slider wedge 2 projecting from the lower ends of the wedge guide members 1*a* and 1*b* from being damaged by rock debris etc.

Furthermore, FIG. 7 illustrates the condition in according to the present invention is inserted into a hole 7 which has previously been drilled by means of a drill etc. in the rock R to be broken up.

Further, FIG. 8 is a fragmentary, enlarged schematic longitudinal sectional view showing the relationship between the respective leading ends of the wedge guide members 1*a* and 1*b* and the end protector 6 before rock breaking operation in the wedge type rock breaking apparatus according to the present invention. In this drawing, the condition of the slider wedge 2 which has been thrusted in the end protector 6 is shown by two-dot chain line. Further, since the slider wedge 2 is reciprocated by the action of the hydraulic actuator means C which includes a piston reciprocable over a predetermined stroke, the wedge 2 can be moved downwards by a predetermined range of stroke.

It is to be understood that the foregoing description is merely illustrative of the preferred embodiments of the present invention, and that the invention is not to be limited thereto, but is to be determined by the scope of the appended claims.

What we claim is:

1. A wedge type rock breaking apparatus comprising wedge guide members divided into halves and adapted to be inserted into a hole which has previously been drilled in the rock to be broken up, said haves defining oppsite respective divided surfaces; a slider wedge adapted to be thrusted in between said wedge guide members to thereby spread or move the latter away from each other; and a pair of dust-proof membranes adapted to be attached across both ends of the opposite respective divided surfaces of said wedge guide members, chartacterized by that said dust-proof membranes each have projections formed as an integral unit along both longitudinal sides edges thereof, each of said projections being adapted to be thrusted into each of longitudinally extended grooves of "C"-shaped cross-section formed along the respective divided surfces of said wedge guide members on both sides thereof and whose both side surfaces extend at right angles to the bottom surface therof.

2. The wedge type rock breaking apparatus as claimed in claim 1, characterized by that said dust-proof membranes are made of a flexible material.

3. The wedge type rock breaking apparatus as claimed in claim 1, characterized by that said projections formed along both side edges of said dust-proof membranes have an approximately diamond-shaped cross-section.

4. The wedge type rock breaking apparatus as claimed in claim 3, characterized by that each of said projections of an approximately diamond-shaped cross-section has a plurality of thin walled portions formed at a predetermined space interval in the longitudinal direction thereof.

5. A wedge type rock breaking apparatus, comprising wedge guide members divided into halves and adapted to be inserted into a hole which has previously been drilled in the rock to be broken up, said halves defining opposite respective divided surfaces; a slider wedge adapted to be thrusted in between said wedge guide members to thereby spread or move the latter away from each other, and a pair of dust-proof membranes adapted to be attached across both ends of the opposite respective divided surfaces of said wedge guide members, characterized by that said dust-proof membranes each have projections formed as an integral unit along both longitudinal side edges thereof, each of said projections being adapted to be thrusted into each of longitudinally extending grooves of "C"-shaped cross-section formed along the respective divided surfaces of said wedge guide members on both sides thereof and whose both side surfaces extend at right angles to the bottom surface thereof, and that said apparatus comprises further a pair of side protectors mounted in opposed relationship with said wedge guide members and whose respective upper ends are connected to members supported by the body of the apparatus, and a cylindrical end protector which includes a bottom portion and which is connected to the respective lower ends of said side protectors and whose open upper end is located opposite to the leading ends of both of said wedges guide members.

6. The wedge type rock breaking apparatus as claimed in claim 5, characterized by that said dust-proof memberanes are made of a flexible material.

7. The wedge type rock breaking apparatus as claimed in claim 5, characterized by that said projections formed along both side edges of said dust-proof membranes have an approximately diamond-shaped cross-section.

8. The wedge type rock breaking apparatus as claimed in claim 7, characterized by that said projections of an approximately diamond-shaped cross-section have a plurality of thin walled portions formed at a predetermined space interval in the longitudinal direction thereof.

* * * * *